US005337761A

United States Patent [19]

Okumoto

[11] Patent Number: 5,337,761

[45] Date of Patent: Aug. 16, 1994

[54] SYSTEM AND A METHOD FOR MANUFACTURING CIGARETTES

[75] Inventor: Yutaka Okumoto, Tokyo, Japan

[73] Assignee: Japan Tobacco Inc., Tokyo, Japan

[21] Appl. No.: 175,575

[22] Filed: Dec. 30, 1993

[30] Foreign Application Priority Data

Mar. 29, 1993 [JP] Japan ..... 5-070280

[51] Int. Cl.[5] ..... A24C 5/18

[52] U.S. Cl. ..... 131/84.1; 131/84.2

[58] Field of Search ..... 131/84.1–84.4, 131/280, 64.1, 66.1, 77, 80, 81.1; 493/39, 42, 50

[56] References Cited

U.S. PATENT DOCUMENTS 5,072,742 12/1991 Heitmann ..... 131/84.1 X

FOREIGN PATENT DOCUMENTS 624846 9/1961 Italy ..... 131/84.4

4014560 3/1959 Japan .

*Primary Examiner*—Jennifer Bahr

[57] ABSTRACT

A cigarette. manufacturing machine has a first tobacco band for forming a cut tobacco layer by attracting cut tobacco, a folding stack for folding the cut tobacco layer from the first tobacco band into layer portions and piling the layer portions on one another in the direction of delivery of the cut tobacco layer to form a cut tobacco train, a second tobacco band for receiving the formed cut tobacco train by suction from the folding stack and transporting the received cut tobacco train, a wrapping section for forming a cigarette rod in a manner such that the cut tobacco train is wrapped in a paper web, and a cutting section for cutting the formed cigarette rod into individual cigarettes. The method of forming the cigarette using this apparatus is also described.

16 Claims, 6 Drawing Sheets

SYSTEM AND A METHOD FOR MANUFACTURING CIGARETTES

BACKGROUND OF THE INVENTION

1. Field of the Invention

The present invention relates to a system and a method for manufacturing cigarettes, suited for the manufacture of cigarettes of higher hardness.

2. Description of the Related Art

In general, a cigarette manufacturing machine comprises a cut tobacco supply section, a wrapping section, and a cutting section. The wrapping section is supplied with a paper web, which travels in one direction in the wrapping section. The supply section feeds cut tobacco onto the paper web at the starting end of the wrapping section. As the cut tobacco, along with the paper web, passes through the wrapping section, it is wrapped in the web to form a continuous cigarette rod. Thereafter, the formed cigarette rod is delivered from the wrapping section to the cutting section. As it passes through the cutting section, the cigarette rod is cut into individual cigarettes with a predetermined length.

An example of the supply section of a cigarette manufacturing machine is disclosed in Jpn. Pat. Appln. KOKOKU Publication No. 40-14560. This conventional supply section is provided with an endless suction band, that is, a tobacco band as it is called. The tobacco band extends toward the wrapping section, and has one surface formed as a suction surface. Cut tobacco is attracted in a layer to the suction surface of the tobacco band. As the tobacco band travels, the cut tobacco layer is transported toward the wrapping section. The tobacco layer is released from the attraction at the starting end of the wrapping section, whereupon the cut tobacco is continuously fed from the tobacco band onto the paper web at the wrapping section.

As shown in FIG. 1, a cut tobacco layer $T_L$ is formed of individual tobacco shreds $K_T$ which are stacked on a suction surface of a tobacco band 1. Thereafter, the tobacco shred $K_T$ of the layer is fed onto a paper web at the wrapping section.

As the paper web 2, along with the tobacco shreds $K_T$, passes through the wrapping section, it is first bent in the shape of a U, as shown in FIG. 2. Thereafter, both sides of the U-shaped web 2 are successively bent in a circular arc, whereupon a continuous cigarette rod is formed.

FIG. 3 shows a filter cigarette which is formed of a cigarette obtained by cutting the cigarette rod and a filter connected to the cigarette. FIG. 4 shows an end face of the filter cigarette. In FIGS. 3 and 4, reference numeral 3 denotes a lap portion which combines both side edges of the paper web 2.

As is evident from the foregoing description of the process for forming the cigarette rod, the tobacco shreds $K_T$ on the paper web 2 are kept substantially in layers even though they are wrapped in the web 2. Also, most of the tobacco shreds $K_T$ in the cigarette are oriented in one direction.

More specifically, most of the tobacco shreds $K_T$ are obtained by cutting tobacco leaves. As shown in the exaggerated view of FIG. 5, these tobacco shreds $K_T$ are rectangular fragments each having a pair of long sides $K_{le}$ with a length L and a pair of short sides $K_{se}$ with a length S.

Most of these fragments $K_T$ tend to be attracted to the tobacco band 1 with an orientation such that their respective long sides $K_{le}$ extend along the traveling direction of the tobacco band 1. As shown in FIGS. 1 and 2, therefore, most of the stacked fragments $K_T$ are oriented so that their short sides $K_{se}$ extend parallel to the cross section of the tobacco band 1 or the paper web 2, and their long sides $K_{le}$ at right angles to the cross section.

As viewed from the end face of the cigarette shown in FIG. 4, most of the individual tobacco shreds $K_T$ are wrapped in the paper web 2 in a manner such that their short sides $K_{se}$ extend parallel to the lap portion 3 of the cigarette.

The tobacco shreds $K_T$ more easily undergo elastic deformation when their opposite surfaces $K_F$ (see FIG. 5) are subjected to external forces than when their long and short sides $K_{le}$ and $K_{se}$ receive external forces.

Thus, if the cigarette is subjected to external forces in the direction A—A, as shown in FIG. 5, these forces act on the opposite surfaces of most of the tobacco shreds $K_T$ in the cigarette, so that the outer peripheral surface of the cigarette is easily deformed.

If the cigarette is subjected to external forces in the direction B—B, on the other hand, these forces act on the long sides $K_{le}$ of most of the tobacco shreds $K_T$ in the cigarette, so that the outer peripheral surface of the cigarette cannot be easily deformed.

This hardness characteristic of the cigarette is also indicated by the result of an experiment. More specifically, the hardness of the cigarette is 5% higher in the direction B—B than in the direction A—A.

If the hardness of the cigarette is thus irregular with respect to the circumferential direction thereof, the outer peripheral surface of the cigarette is easily deformed.

SUMMARY OF THE INVENTION

The object of the present invention is to provide a system and a method for manufacturing cigarettes which have an improved uniform hardness in the circumferential direction thereof.

The above object is achieved by a manufacturing system or manufacturing method according to the present invention. The manufacturing system comprises: a cut tobacco supply section including first supply means having a first suction surface traveling in one direction, whereby cut tobacco is attracted in a layer to the first suction surface and the attracted cut tobacco layer is delivered continuously as the first suction surface travels, folding/forming means for folding the cut tobacco layer from the first supply means into layer portions and piling the layer portions on one another in the direction of delivery of the cut tobacco layer to form a cut tobacco train, and second supply means having a second suction surface traveling in the one direction, whereby the cut tobacco train is attracted from the folding/forming means to the second suction surface and the attracted cut tobacco train is delivered continuously as the second suction surface travels; wrapping means for forming a continuous cigarette rod in a manner such that the cut tobacco train from the second suction surface is received on a paper web traveling in the one direction and is wrapped in the paper web; and cutting means for cutting the formed cigarette rod into individual cigarettes.

The manufacturing method of the present invention comprises: a cut tobacco supply step including a first supply process for forming a layer of cut tobacco by suction and continuously delivering the formed cut tobacco layer, a folding/forming process for folding the delivered cut tobacco layer into layer portions and piling the layer portions on one another in the direction of delivery of the cut tobacco layer to form a cut tobacco train, and a second supply process for receiving the formed cut tobacco train by suction and continuously delivering the attracted cut tobacco train; a wrapping step for forming a continuous cigarette rod from the cut tobacco train and a paper web; and a cutting step for cutting the formed cigarette rod into individual cigarettes.

Concretely, the folding/forming means of the includes a folding passage horizontally extending between the first supply means and the second supply means, and the first supply means delivers the cut tobacco layer into the folding passage at a predetermined initial velocity.

Preferably, in the manufacturing system and the manufacturing method described above, the cut tobacco layer is compressed. In the manufacturing system, moreover, the folding/forming means includes a tunnel-shaped passage which extends from the first supply means to the second supply means.

According to the manufacturing system and the manufacturing method described above, the cut tobacco layer is folded into layer portions, and the layer portions are piled on one another to form the cut tobacco train. Therefore, the individual tobacco shreds in the cut tobacco train are stacked in layers in the lengthwise direction of the tobacco train.

When the cut tobacco train thus formed is wrapped in the paper web to form the continuous cigarette rod, the tobacco shreds in the cigarette rod extend at right angles to the paper web or wrapper, so that the circumferential hardness of the cigarette rod is uniform and higher than that of a conventional cigarette rod.

If the required hardness is substantially equal to that of the conventional cigarette rod, the quantity of the tobacco shreds in the cigarette rod, that is the fill of the tobacco shreds, can be reduced.

Hardened cigarettes are obtained by cutting the formed cigarette rod, thereafter.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENT

Figure 6:
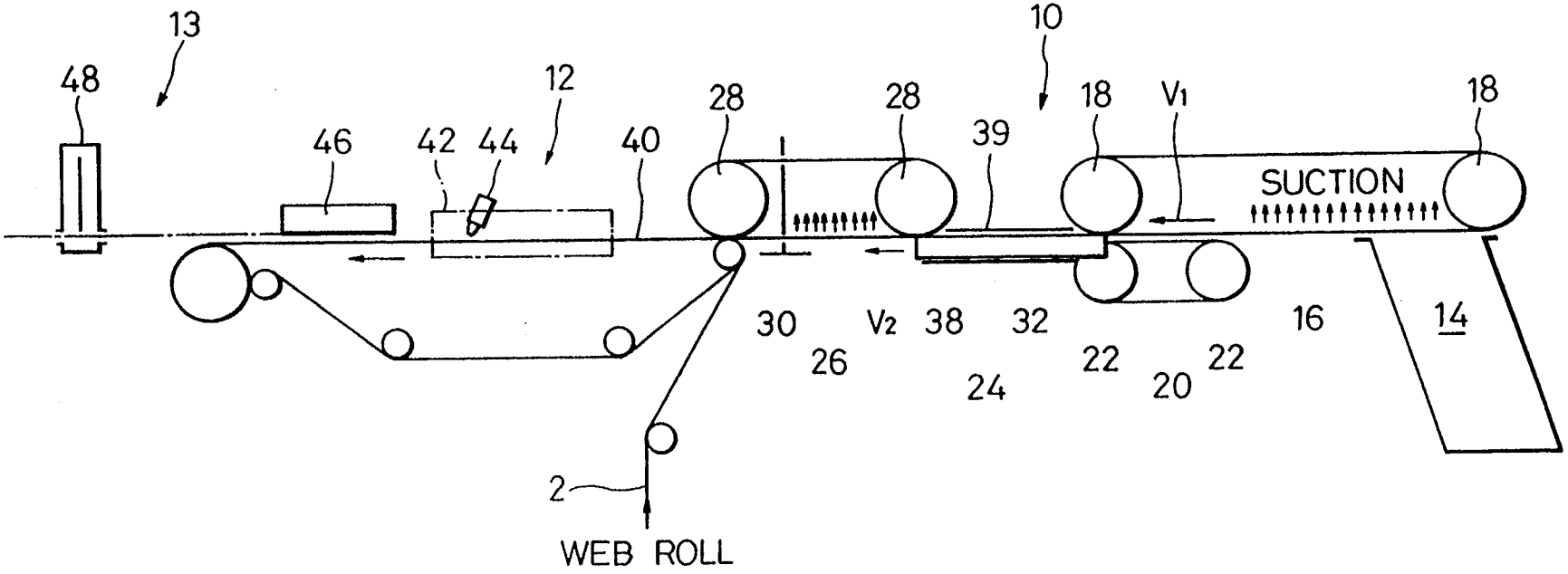
FIG. 6 is a schematic view showing a cigarette manufacturing machine according to one embodiment of the present invention.

A cigarette manufacturing machine shown in FIG. 6 comprises a cut tobacco supply section 10, wrapping section 12, and a cutting section 13. These sections 10, 12 and 13 are arranged successively from right to left of FIG. 6.

The supply section 10 includes a chimney 14, and tobacco shreds are introduced into the chimney 14 through a supply drum (not shown). The introduced tobacco shreds are sucked in together with air, and ascend in the chimney 14.

A top opening of the chimney 14 is closed by a first tobacco band 16, which extends toward the wrapping section 12. The band 16 is formed of an endless suction belt, which is formed having a number of suction holes (not shown). The first tobacco band 16 is passed around and between a pair of drums 18, and is run in the direction of the arrow of FIG. 6 at a predetermined traveling speed $V_1$.

The tobacco shreds, ascending together with air in the chimney 14, are attracted in a layer to the underside of the first tobacco band 16, whereby a cut tobacco layer with a predetermined thickness is formed on the band 16. As the first tobacco band 16 travels, the tobacco layer is transported from the chimney 14 to the wrapping section 12.

Figure 1:
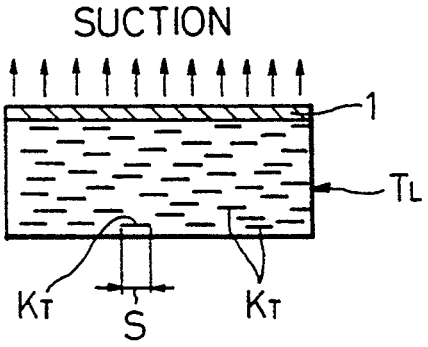
FIG. 1 (PRIOR ART)
FIG. 1 is a view showing cut tobacco attracted in a layer to a tobacco band.
Figure 2:
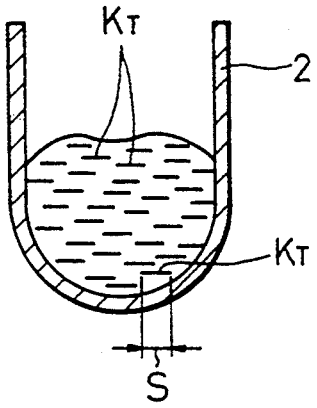
FIG. 2 (PRIOR ART)
FIG. 2 is a view showing the paper web of FIG. 1 bent in the shape of a U.
Figure 3:
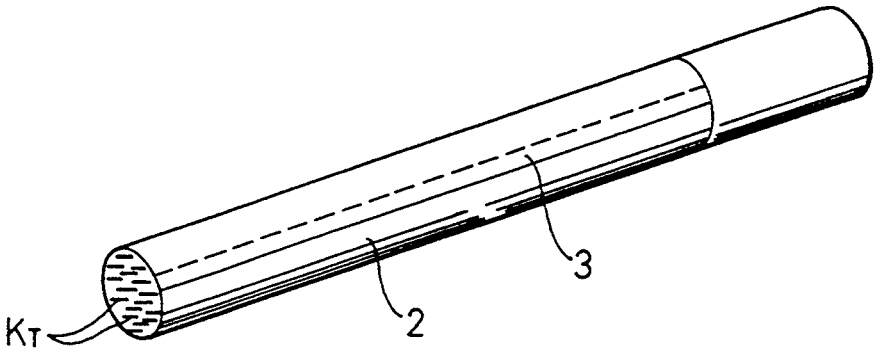
FIG. 3 (PRIOR ART)
FIG. 3 is a perspective view of a filter cigarette manufactured by the conventional method.
Figure 4:
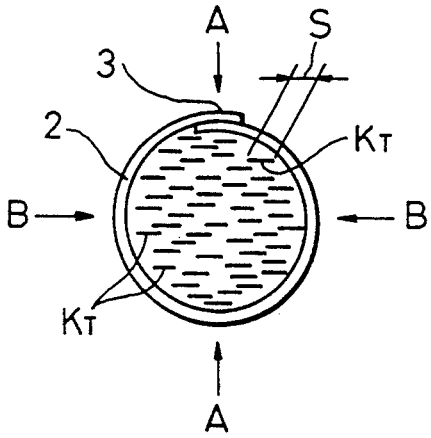
FIG. 4 (PRIOR ART)
FIG. 4 is an end view of the filter cigarette shown in FIG. 3.
Figure 5:
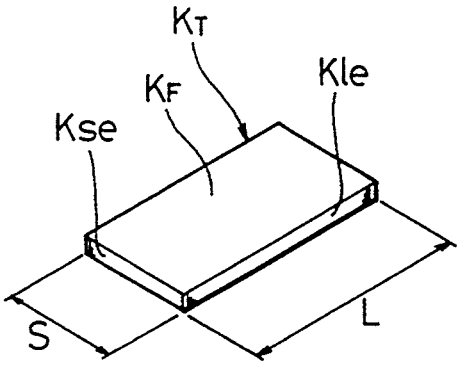
FIG. 5 is an enlarged perspective view of a tobacco shred.

The cut tobacco layer on the first tobacco band 16 is formed in the same manner as the cut tobacco layer $T_L$ on the tobacco band 1 shown in FIG. 1. However, the traveling speed $V_1$ of the first tobacco band 16 is N times (e.g., five times) as high as that of the tobacco band 1 of FIG. 1. Therefore, the tobacco band 16 moves on the chimney 14 in a shorter period of time than the tobacco band 1, so that the tobacco layer on the band 16 is about one- N'th as thick as the tobacco layer $T_L$ on the band 1.

The traveling speed of the tobacco band 1 is set on the basis of the quantity of cut tobacco to be supplied to a paper web 2.

A tobacco drum may be used in place of the first tobacco band 16. In this case, the outer peripheral surface of the tobacco drum is formed as a suction surface.

An endless press belt 20 underlies the terminal end portion of the first tobacco band 16. The belt 20, which is situated right under the band 16, is passed around and between a pair of rollers 22. The roller 22 on the left of the press belt 20, as in FIG. 6, is situated right under the drum 18 of the first tobacco band 16.

The press belt 20 is run at a speed equal to the traveling speed $V_1$ of the first tobacco band 16. The traveling direction of the belt 20 is opposite to that of the band 16. Thus, those portions of the band 16 and the belt 20 which face each other travel in the same direction and at the same speed.

The press belt 20 has a width equal to that of the first tobacco band 16. The distance between the belt 20 and the band 16 is a little shorter than the thickness of the cut tobacco layer formed on the belt 16.

The press belt 20 is vertically movable with respect to the first tobacco band 16, so that the distance between the belt 20 and the band 16 is adjustable, and a jam, if any, of the tobacco layer between the belt 20 and the band 16 can be removed.

Located on the left of the combination of the first tobacco band 16 and the press belt 20, as in FIG. 6, is an endless second tobacco band 26 which is connected to the wrapping section 12. The first and second tobacco bands 16 and 26 are connected to each other by means of a folding stack 24 for the cut tobacco layer.

The second tobacco band 26, like the first tobacco band 16, is formed of a suction belt, and is passed around and between a pair of drums 28. The traveling speed $V_2$ of the second tobacco band 26 is adjusted to one-N'th of the traveling speed $V_1$ of the first tobacco band 16. As mentioned later, the second tobacco band 26 continuously receives a cut tobacco train from the folding stack 24 and attracts the cut tobacco train on the underside thereof.

The second tobacco band 26 is provided with a trimming disk 30, which regulates the thickness of the cut tobacco train attracted to the band 26 as it rotates. Thus, trimmed cut tobacco train is fed from the second tobacco band 26 to the wrapping section 12.

Figure 7:
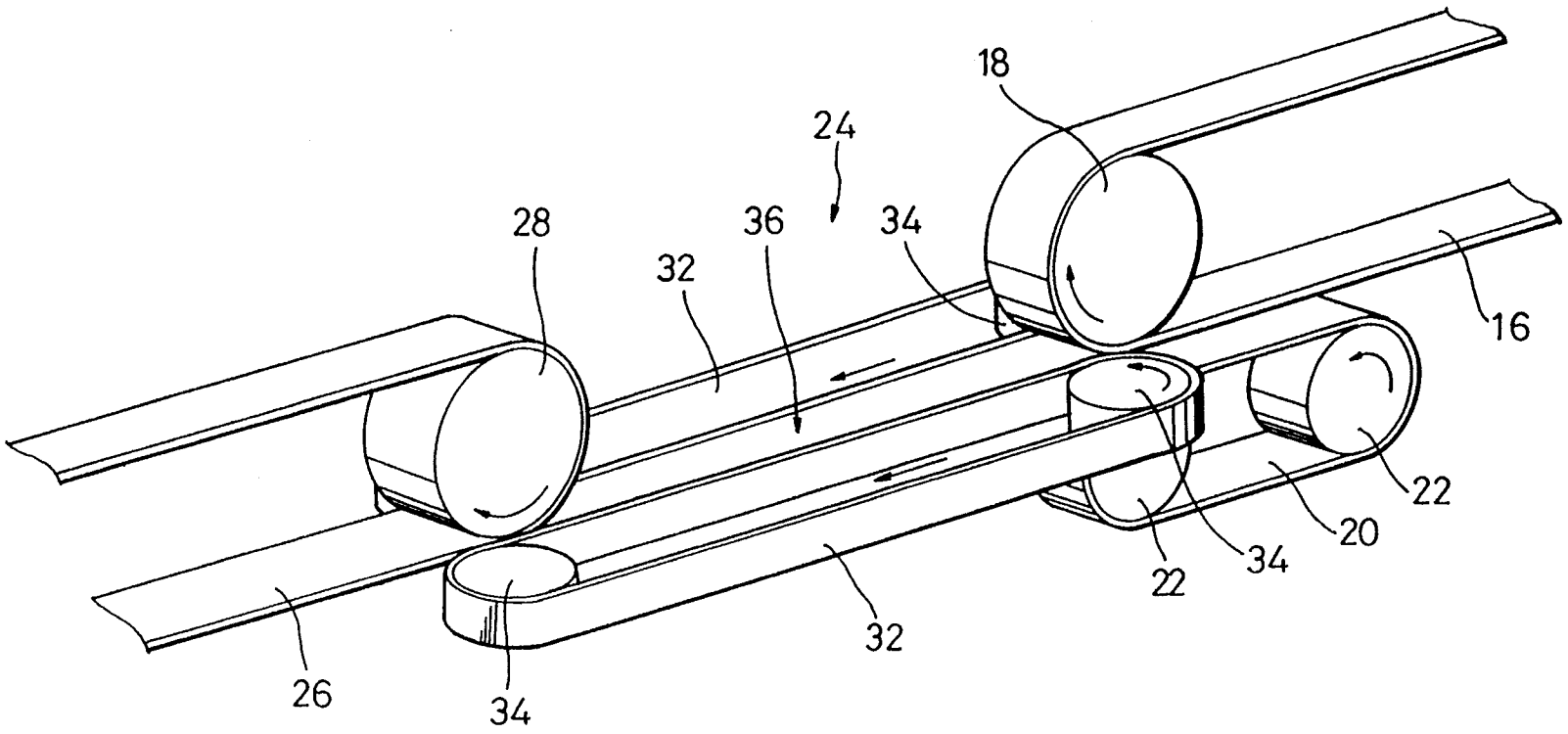
FIG. 7 is an enlarged perspective view showing a terminal end portion of a first tobacco band in a supply section of FIG. 6.

As seen from FIG. 7, the folding stack 24 includes a pair of side belts 32. Each side belt 32 is an endless suction belt which is passed around and between a pair of rollers 34. The respective axes of the rollers 34, unlike those of the drums 18 and 28 and the rollers 22, extend vertically. Thus, the paired side belts 32 extend parallel to each other between the first and second tobacco bands 16 and 26 so as to have their respective vertical belt surfaces facing each other.

The paired side belts 32 travel at a speed equal to the traveling speed $V_2$ of the second tobacco band 26 in a manner such that the aforesaid belt surfaces move from the first tobacco band 16 toward the second band 26, as indicated by the arrows in FIG. 7.

A distance equal to the width of each of the first and second tobacco bands 16 and 26 is secured between the paired side belts 32, and the width of each side belt 32 is set to be about N times the thickness of the cut tobacco layer formed on the first tobacco band 16.

Figure 10:
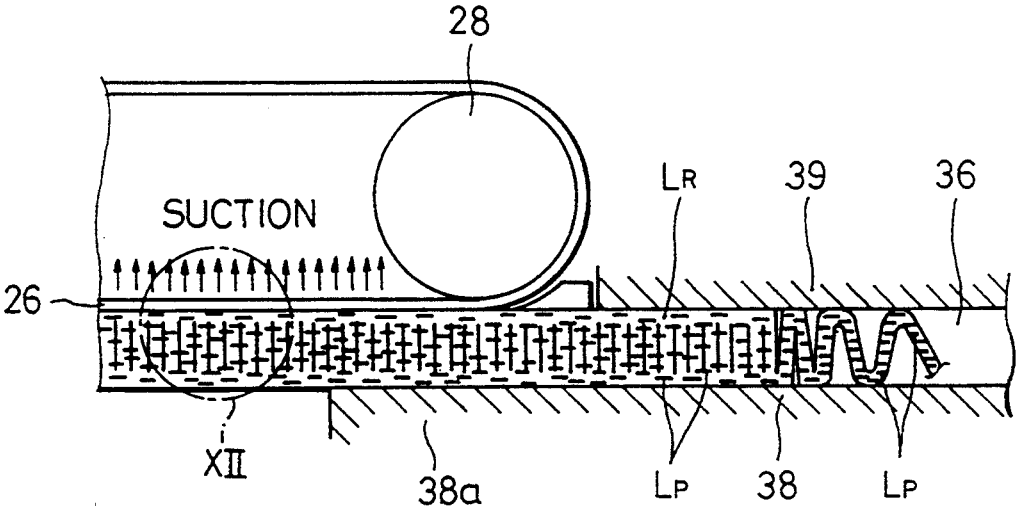
FIG. 10 is an enlarged sectional view showing a starting end portion of a second tobacco band in the supply section.

As shown in FIG. 6, a lower plate 38 and an upper plate 39 are arranged right over and under the side belts 32, respectively. These plates 38 and 39 extend from the first tobacco band 16 toward the second tobacco band 26. More specifically, as shown in FIG. 10, the upper plate 39 extends to the point just short of the starting end portion of the second tobacco band 26, while the lower plate 38 has an extension portion 38*a* which underlies the starting end portion of the band 26 with an overlap of a predetermined length.

The aforesaid belt surfaces of the paired side belts 32 and the lower and upper plates 38 and 39 form walls which define a folding passage 36 which extends between the first and second tobacco bands 16 and 26. The passage 36 has a rectangular cross section.

The height of the folding passage 36, which depends on the width of each side belt 32, is about N times the thickness of the cut tobacco layer formed on the first tobacco band 16.

A passage or opening between the first tobacco band 16 and the press belt 20 is situated on the level of the upper portion of the folding passage 36.

That one of the side belts 32 which is situated to the front side of the cigarette manufacturing machine is movable toward and away from the other side belt. Thus, the width of the folding passage 36 can be adjusted, and the jammed cut tobacco in the passage 36 can be removed.

The first tobacco band 16, press belt 20, second tobacco band 26, and side belts 32 are driven by a drive system of the cigarette manufacturing machine with the aid of a power transmission system including gear belts and the like, or are driven individually by electric motors.

The second tobacco band 26 and the folding stack 24 may be replaced individually with perforated suction drums. In this case, the suction drum for the folding stack 24 is formed having an arcuate folding passage on part of its outer peripheral surface.

The following is a description of a cut tobacco supply method carried out by means of the aforementioned supply section 10.

Figure 8:
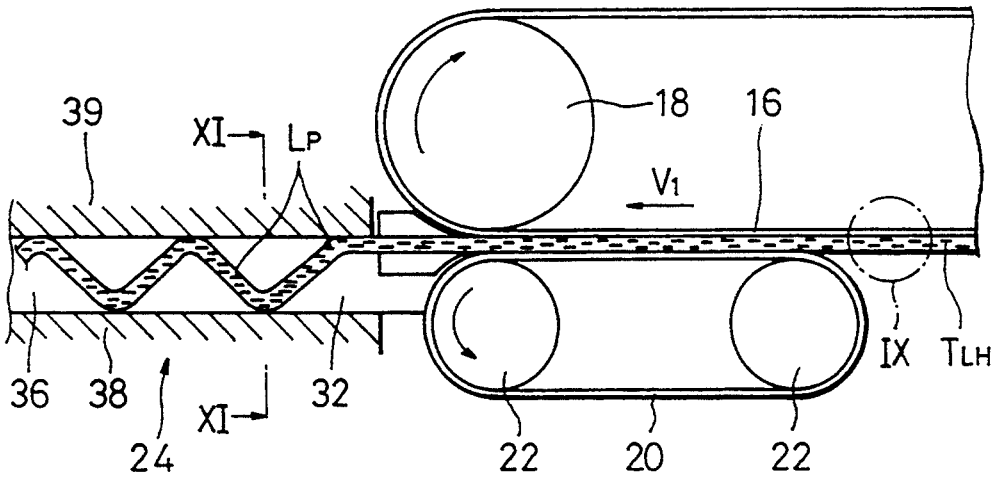
FIG. 8 is a vertical sectional view of the part shown in FIG. 7.
Figure 9:
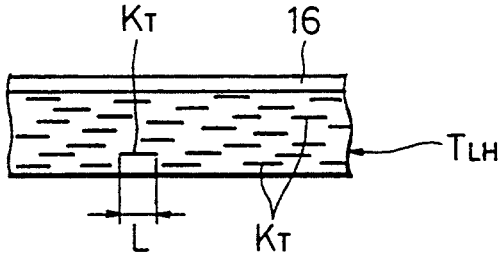
FIG. 9 is an enlarged view of a region IX shown in FIG. 8.

As the first tobacco band 16 travels, a cut tobacco layer $T_{LH}$ thereon is first transported to the folding stack 24, as shown in FIG. 8. At this time, most of tobacco shreds $K_T$ which form the tobacco layer $T_{LH}$ tend to be attracted in the aforesaid manner so that their respective long sides $K_{le}$ extend along the traveling direction of the first tobacco band 16, as shown in FIG. 9.

After the cut tobacco layer $T_{LH}$ on the first tobacco band 16 is compressed between the band 16 and the press belt 20, it is released from the attraction by the band 16. Thus, the cut tobacco layer $T_{LH}$, which is transported as the tobacco band 16 travels, is delivered from between the band 16 and the belt 20 into the folding stack 24 or the folding passage 36.

Since the cut tobacco layer $T_{LH}$ is compressed, its individual tobacco shreds $K_T$ are intertwined with one another. Thus, the tobacco layer $T_{LH}$ are delivered into the folding passage 36 while maintaining its shape.

As mentioned before, the height of the folding passage 36 is about N times the thickness of the cut tobacco layer $T_{LH}$, the passage between the first tobacco band 16 and the press belt 20 is situated on the level of the upper portion of the passage 36 and the speed of the folding passage 36 or the side belts 32 is set to one-N'th of the traveling speed of the first tobacco band 16. Accordingly, the tobacco layer $T_{LH}$ delivered from between the band 16 and the belt 20 dives into the folding passage 36 at the initial velocity $V_1$ and vertically undulates like waves in the folding passage 36, as shown in FIG. 8. However, the amplitude of the undulation of the tobacco layer $T_{LH}$ is regulated by the lower and upper plates 38 and 39 which constitute the lower and upper walls, respectively, of the passage 36.

In the folding passage 36, therefore, the cut tobacco layer $T_{LH}$ advances with alternate turns $L_p$ of a predetermined length. As shown in FIG. 10, therefore, these layer turns $L_p$ securely pile in intimate contact with one another in their advancing direction at the terminal end portion of the folding passage 36, whereupon the cut tobacco train $L_R$ is formed including the layer turns $L_p$ continuous with one another.

Figure 11:
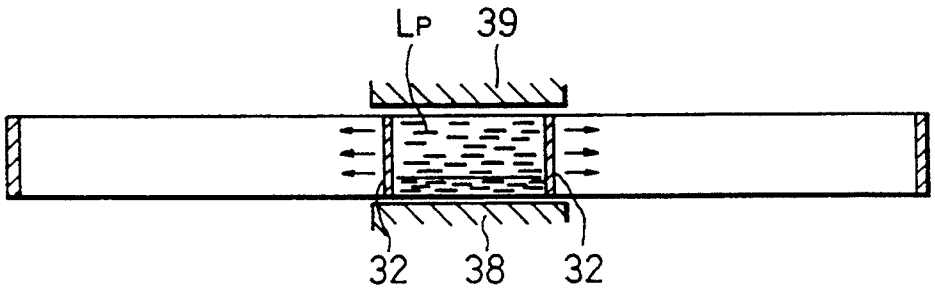
FIG. 11 is a sectional view taken along line XI—XI of FIG. 8.

Meanwhile, the respective belt surfaces of the paired side belts 32, which form the opposite side walls of the folding passage 36, attract the layer turns $L_p$ from both sides, as shown in FIG. 11, and travel in the same direction as the first tobacco band 16 at the speed $V_2$ lower than the traveling speed $V_1$ of the band 16. Thus, the side belts 32 prevent the advancing speed of the layer turns $L_p$ in the folding passage 36 from suddenly dropping, and forms the cut tobacco train $L_R$ with stability. Further, the belts 32 transports the formed tobacco train $L_R$ from the folding passage 36 toward the second tobacco band 26.

The higher the traveling speed $V_1$ of the first tobacco band 16, the thinner the cut tobacco layer $T_{LH}$ formed on the band 16 and the individual layer turns $L_p$ forming the cut tobacco train $L_R$ will be. As a result, the number of layer turns $L_p$ per unit length of the tobacco train $L_R$ can be increased. If the tobacco layer $T_{LH}$ is too thin, however, the tobacco train $L_R$ cannot be formed. Thus, the traveling speed $V_1$ of the first tobacco band 16 should be set properly.

Although the traveling speed $V_1$ of the first tobacco band 16 and the press belt 20 is N times as high as the traveling speed $V_2$ of the paired side belts 32, as mentioned before, the width of each side belt 32, that is, the height of each side wall of the folding passage 36, is about N times the thickness of the cut tobacco layer $T_{LH}$. Therefore, the delivery of the tobacco layer $T_{LH}$ from the first tobacco band 16 is equal to the delivery of the cut tobacco train $L_R$ from the folding passage 36. Thus, the tobacco train $L_R$ can be steadily supplied to the second tobacco band 26 in a manner such that it is guided by the lower plate 38 of the folding stack 24.

Since the second tobacco band 26 is run at the traveling speed $V_2$ which is equal to the traveling speed of the side belts 32, the cut tobacco train $L_R$, delivered from the folding passage 36 and supported on the lower plate 38, are securely attracted to the second tobacco band 26. As the band 26 travels, therefore, the tobacco train $L_R$ is transported toward the aforesaid wrapping section 12. In doing this, the tobacco train $L_R$ passes through the trimming disk 30, and is trimmed as the disk 30 rotates.

Figure 12:
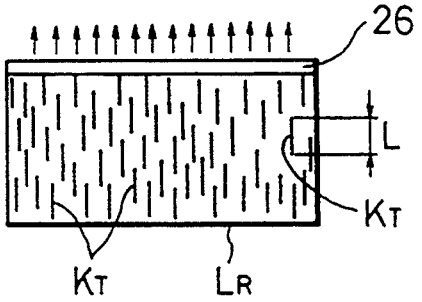
FIG. 12 is an enlarged view of a region XII shown in FIG. 10.

As is evident from the foregoing description, the cut tobacco train $L_R$ is formed by piling the layer turns $L_p$ on one another in the advancing direction thereof, so that the long sides $K_{le}$ of most of the tobacco shreds $K_T$ are not parallel to the suction surface of the second tobacco band 26, but extend vertically, as shown in FIG. 12. Thus, the tobacco train $L_R$ constitutes a stack in which the respective surfaces of most of the tobacco shreds $K_T$ pile on one another in the traveling direction of the suction of the second tobacco band 26.

Thereafter, the cut tobacco train $L_R$ is transferred from the second tobacco band 26 to the paper web 2 in the wrapping section 12. In this section 12, a cigarette rod is continuously formed from the paper web 2 and the tobacco train $L_R$ in the conventional manner.

More specifically, the wrapping section 12 is provided with an endless garniture tape 40 which is used for the transportation of the paper web 2 and the formation of the cigarette rod, as shown in FIG. 6. When the garniture tape 40 is run in the direction of the arrow of FIG. 6, the paper web 2 paid out from a web roll (not shown) passes the wrapping section 12 in a manner such that it is put on the tape 40.

When the cut tobacco train $L_R$ on the paper web 2 passes a rod mold 42 of the wrapping section 12, the paper web 2 is bent in the shape of a U, and a paste is applied to one side edge of the U-shaped paper web 2 by means of a paste applicator 44. Thereafter, both sides of the U-shaped web 2 are successively bent in a circular arc, and are lapped to be bonded to each other, whereby a continuous cigarette rod is formed.

As the formed cigarette rod passes a dryer 46 located between the wrapping section 12 and a cutting device 48 in the cutting section 13, its paste-covered portion is dried. The cutting device 48 cuts the cigarette rod into individual cigarettes with a predetermined length.

Figure 13:
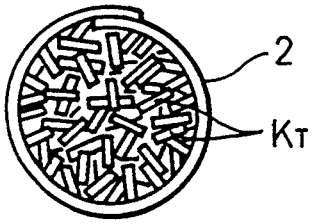
FIG. 13 is an end view of a cigarette manufactured by means of the cigarette manufacturing machine shown in FIG. 6.
Figure 6:
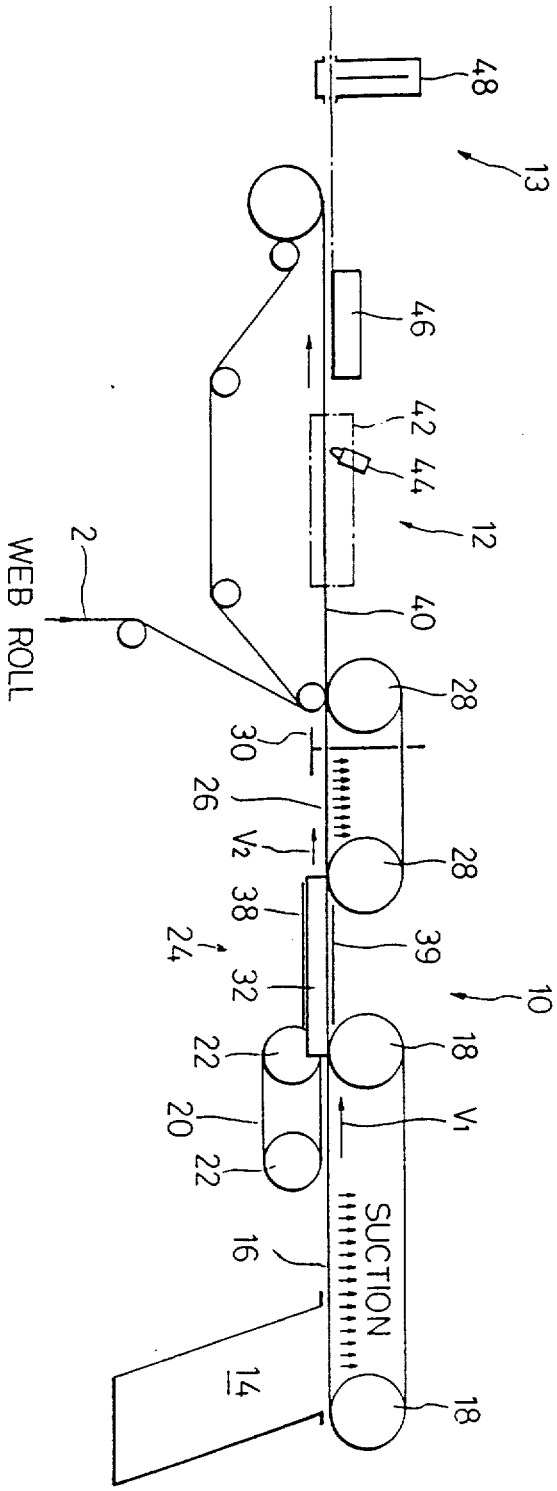

Since most of the tobacco shreds $K_T$ of the cut tobacco train $L_R$ on the paper web 2 extend at right angles to the web 2, the tobacco shreds $K_T$ in the cigarette rod formed in the aforesaid manner are arranged radially on a cross section of the rod, as shown in FIG. 13.

Accordingly, the formed cigarette rod or each cigarette has a uniform hardness with respect to its circumferential direction, and is harder than a conventional cigarette.

Thus, the cigarettes manufactured by means of the cigarette manufacturing machine of the present invention have an increased strength against external force, and cannot be easily deformed.. Also, the external appearance of the cigarettes can be maintained despite the execution of a process for manufacturing filter cigarettes by attaching a filter to each cigarette and a process for encasing the filter cigarettes.

If a hardness substantially equal to that of the conventional cigarettes is permitted, the fill of the cut tobacco in each cigarette obtained according to the present invention can be made smaller than that for each conventional cigarette, so that the manufacturing cost can be reduced.

It is to be understood that the present invention is not limited to the one embodiment described above, and that various changes and modifications may be effected therein by one skilled in the art without departing from the scope or spirit of the invention. In the above-described embodiment, for example, the folding passage 36 of the folding stack 24 is defined by the pair of side belts 32 and the pair of plates 38 and 39. However, these members may be replaced with a fixed member having the folding passage 36 defined therein. Preferably, in this case, the inner surface of the passage 36 should be smooth enough to guide the cut tobacco train satisfactorily in sliding motion as the tobacco train is formed.

What is claimed is:

1. A cigarette manufacturing system comprising:

a cut tobacco supply section including first supply means having a first suction surface travelling in one direction having means for attracting cut tobacco in a layer to the first suction surface and delivering the attracted cut tobacco layer continuously as the first suction surface travels, folding means for folding the cut tobacco layer from the first supply means into layer portions and piling the layer portions on one another in the direction of delivery of the cut tobacco layer to form a cut tobacco train, and second supply means having a second suction surface traveling in the one direction having means for attracting the cut tobacco train from the folding means to the second suction surface and delivering the attracted cut tobacco train continuously as the second suction surface travels;

wrapping means for forming a continuous cigarette rod in a manner such that the cut tobacco train from the second suction surface is received on a paper web traveling in the one direction and is wrapped in the paper web; and cutting means for cutting the formed cigarette rod into individual cigarettes.

2. A system according to claim 1, wherein said folding means includes a folding passage horizontally extending from the first supply means to the second supply means and having a height Greater than the thickness of the cut tobacco layer formed on the first suction surface, the cut tobacco layer diving from said first supply means into the folding passage at a predetermined initial velocity.

3. A system according to claim 2, wherein said folding passage is defined by a bottom wall, a top wall, and a pair of side walls, and has a rectangular cross section.

4. A system according to claim 3, wherein the pair of side walls of said folding passage are movable walls traveling from the first supply means toward the second supply means.

5. A system according to claim 4, wherein each said movable wall is formed of an endless belt.

6. A system according to claim 4, wherein each said movable wall is formed of an endless suction belt.

7. A system according to claim 6, wherein each said movable wall travels at a speed lower than the speed of the first suction surface of the first supply means and equal to the speed of the second suction surface of the second supply means.

8. A system according to claim 7, wherein said first suction surface has a traveling speed N, N being a number greater than 1, times that of the second suction surface when the thickness of the cut tobacco layer formed on the first suction surface is equal to one-N'th of the height of the folding passage.

9. A system according to claim 7, wherein the bottom wall of said folding passage includes an extension portion overlapping with the second suction surface.

10. A system according to claim 2, wherein said first supply means includes an opening through which the cut tobacco layer is delivered, the opening being situated to an upper portion of the folding passage.

11. A system according to claim 1, wherein said first supply means includes compression means for compressing the cut tobacco layer against the first suction surface.

12. A system according to claim 11, wherein said first supply means includes an endless tobacco band constituting the first suction surface, and said compression means includes an endless press belt located at a predetermined distance from the first suction surface of the tobacco band.

13. A cigarette manufacturing method comprising:

a cut tobacco supply step including a first supply process for forming a layer of cut tobacco by suction and continuously delivering the formed cut tobacco layer, a folding process for folding the delivered cut tobacco layer into layer portions and piling the layer portions on one another in the direction of delivery of the cut tobacco layer to form a cut tobacco train, and a second supply process for receiving the formed cut tobacco train by suction and continuously delivering the attracted cut tobacco train;

a wrapping step for forming a continuous cigarette rod from the cut tobacco train and a paper web; and a cutting step for cutting the formed cigarette rod into individual cigarettes.

14. A method according to claim 13, wherein said folding process is executed by diving the cut tobacco layer with a predetermined initial velocity.

15. A method according to claim 13, wherein said supply step further includes a compression process for compressing the formed cut tobacco layer to reduce the thickness of the tobacco layer.

16. A method according to claim 14, wherein said first supply process includes delivering the cut tobacco layer at a first speed higher than a speed of delivery of the cut tobacco train.

* * * * *

UNITED STATES PATENT AND TRADEMARK OFFICE

CERTIFICATE OF CORRECTION

PATENT NO. : 5,337,761

DATED : August 16, 1994

INVENTOR(S) : Yutaka Okumoto

It is certified that error appears in the above-indentified patent and that said Letters Patent is hereby corrected as shown below:

In the Drawings, Figure 6 should have lead lines to numeral 30, 26, $V_2$ 38,24,32,22 (both occurrences), 20 and 16.

Delete Drawing Sheets Figure 6, and substitute therefor the Drawing Sheets, consisting Figure 6, as shown on the attached page.

Signed and Sealed this

Twentieth Day of December, 1994

*Attest:*

Bruce Lehman

BRUCE LEHMAN

*Attesting Officer*

*Commissioner of Patents and Trademarks*